US007588459B2

(12) United States Patent
Sugii et al.

(10) Patent No.: US 7,588,459 B2
(45) Date of Patent: Sep. 15, 2009

(54) CONNECTING DEVICE HAVING A LOCKING MECHANISM

(75) Inventors: Yoshihiro Sugii, Tokyo (JP); Kazuhiko Furukatsu, Tokyo (JP); Makoto Hayashi, Tokyo (JP); Hiroyuki Maeda, Tokyo (JP); Katsushiro Ishibayashi, Tokyo (JP)

(73) Assignees: Japan Aviation Electronics Industry, Limited, Tokyo (JP); Harada Industry Co., Ltd., Tokyo (JP)

( * ) Notice: Subject to any disclaimer, the term of this patent is extended or adjusted under 35 U.S.C. 154(b) by 124 days.

(21) Appl. No.: 11/881,348

(22) Filed: Jul. 26, 2007

(65) Prior Publication Data

US 2008/0214046 A1 Sep. 4, 2008

(30) Foreign Application Priority Data

Jul. 28, 2006 (JP) ..... 2006-206583

(51) Int. Cl.
*H01R 13/60* (2006.01)
*H01R 13/66* (2006.01)

(52) U.S. Cl. ..... 439/567; 343/715

(58) Field of Classification Search ..... 439/567, 439/557, 565, 544, 555, 560, 575, 562, 357, 439/474; 343/715, 711
See application file for complete search history.

(56) References Cited

U.S. PATENT DOCUMENTS

| | | | | | |
|---|---|---|---|---|---|
| 3,569,909 | A * | 3/1971 | Garver | 439/353 |
| 4,168,874 | A * | 9/1979 | Weidler et al. | 439/557 |
| 4,449,778 | A * | 5/1984 | Lane | 439/610 |
| 4,915,648 | A | 4/1990 | Takase et al. | |
| 5,004,430 | A * | 4/1991 | DelGuidice et al. | 439/350 |
| 5,836,787 | A | 11/1998 | Kodama | |
| 6,065,983 | A * | 5/2000 | Norizuki et al. | 439/157 |
| 6,257,925 | B1 * | 7/2001 | Jones | 439/557 |
| 6,319,042 | B2 | 11/2001 | Hirschmann | |
| 6,332,800 | B2 * | 12/2001 | Kodama | 439/357 |
| 6,984,143 | B2 * | 1/2006 | Roese | 439/352 |
| 7,218,283 | B2 * | 5/2007 | Nagel | 343/711 |
| 7,467,965 | B1 * | 12/2008 | Arai | 439/353 |
| 2007/0173112 | A1 * | 7/2007 | Murakami et al. | 439/557 |

FOREIGN PATENT DOCUMENTS

| | | |
|---|---|---|
| GB | 2 235 341 | 2/1991 |
| JP | 1-132076 | 9/1989 |
| JP | 3-57879 | 6/1991 |

(Continued)

OTHER PUBLICATIONS

Japanese Office Action dated Jun. 18, 2008.

(Continued)

*Primary Examiner*—Hae Moon Hyeon
(74) *Attorney, Agent, or Firm*—Collard & Roe P.C.

(57) ABSTRACT

A connecting device has a locking mechanism for locking fitting between a first connecting member and a mating side. The locking mechanism has a first elastic body and a second elastic body. The first elastic body has a first contact portion adapted to contact the mating side. The second elastic body has a second contact portion adapted to contact the mating side. At least one of the first elastic body and the second elastic body has a locking portion adapted to lock fitting to the mating side.

6 Claims, 6 Drawing Sheets

FOREIGN PATENT DOCUMENTS

| | | |
|---|---|---|
| JP | 05-335056 | 12/1993 |
| JP | 09-283230 | 10/1997 |
| JP | 2000-082538 | 3/2000 |
| JP | 2001-210428 | 8/2001 |
| JP | 2002-008776 | 1/2002 |
| JP | 2002-170635 | 6/2002 |

OTHER PUBLICATIONS

Japanese Office Action dated Sep. 17, 2008.

* cited by examiner

CONNECTING DEVICE HAVING A LOCKING MECHANISM

This application claims priority to prior Japanese patent application JP 2006-206583, the disclosure of which is incorporated herein by reference.

BACKGROUND OF THE INVENTION

This invention relates to a connecting device having a locking mechanism.

As a related art 1, there is a structure for mounting an antenna device with a pigtail harness to a roof panel of a vehicle.

In the operation of mounting the antenna device to the roof panel, a cable is, at first, passed through an antenna mounting hole, formed in the roof panel, from the outside of the roof panel and, then, the cable is gropingly pulled into the inside of the vehicle. Then, the cable is passed through a mounting nut and the nut is tightened using a fastening tool while the nut is supported by hand.

Further, Japanese Unexamined Patent Application Publication (JP-A) No. H09-283230 (Patent Document 1) as a related art 2 discloses a connector holding structure wherein a connector on the side of a component and a connector on the side of a panel are fitted together so that the component is detachably mounted.

In this connector holding structure, a first connecting body having the connector fixed to the component and a second connecting body having the connector disposed on the side of the panel are fitted together by bolts and nuts.

A temporary engaging portion is provided on the side of the first connecting body and a temporary locking portion is provided on the side of the second connecting body. The temporary engaging portion and the temporary locking portion are employed for increasing an engaging force to the panel.

Further, Japanese Unexamined Patent Application Publication (JP-A) No. H05-335056(Patent Document 2) as a related art 3 discloses a body fixing connector to be fitted with a mating connector. This body fixing connector is fixed to a vehicle body by locking it to the vehicle body. A movable locking portion of the body fixing connector has a locking pawl that is locked to a connector mounting hole of the vehicle body upon passing through a flange portion.

In the related art 1, the cable is gropingly pulled into the inside of the vehicle and the nut is tightened using the fastening tool while the nut is supported by hand.

Therefore, since the operation extends over the inside and outside of the vehicle when mounting the antenna device to the roof panel, there is a problem that the operation is complicated and difficult.

Further, in the connector holding structure of Patent Document 1, there is a problem that if an engaging force between the temporary engaging portion and the temporary locking portion is strengthened for increasing the engaging force to the panel, a large force is required at the time of mounting.

Further, in the body fixing connector of Patent Document 2, there is a problem that if an elastic force of the movable locking portion is strengthened for increasing a holding force of the movable locking portion, a large force is required at the time of mounting.

SUMMARY OF THE INVENTION

It is therefore an exemplary object of this invention to provide a connecting device having a locking mechanism that allows insertion with a low insertion force at the time of mounting and still exerts a high holding force.

It is another exemplary object of this invention to provide a connecting device having a locking mechanism that can simplify the mounting operation.

Other objects of the present invention will become clear as the description proceeds.

According to an exemplary aspect of the present invention, there is provided a connecting device having a locking mechanism for locking fitting between a first connecting member and a mating side, wherein the first connecting member comprises a first housing, the first housing has the locking mechanism, the locking mechanism comprises a first elastic body and a second elastic body, the first elastic body has a first contact portion adapted to contact the mating side, the second elastic body has a second contact portion adapted to contact the mating side, at least one of the first elastic body and the second elastic body has a locking portion adapted to lock fitting to the mating side.

DESCRIPTION OF THE PREFERRED EMBODIMENTS

Figure 1:
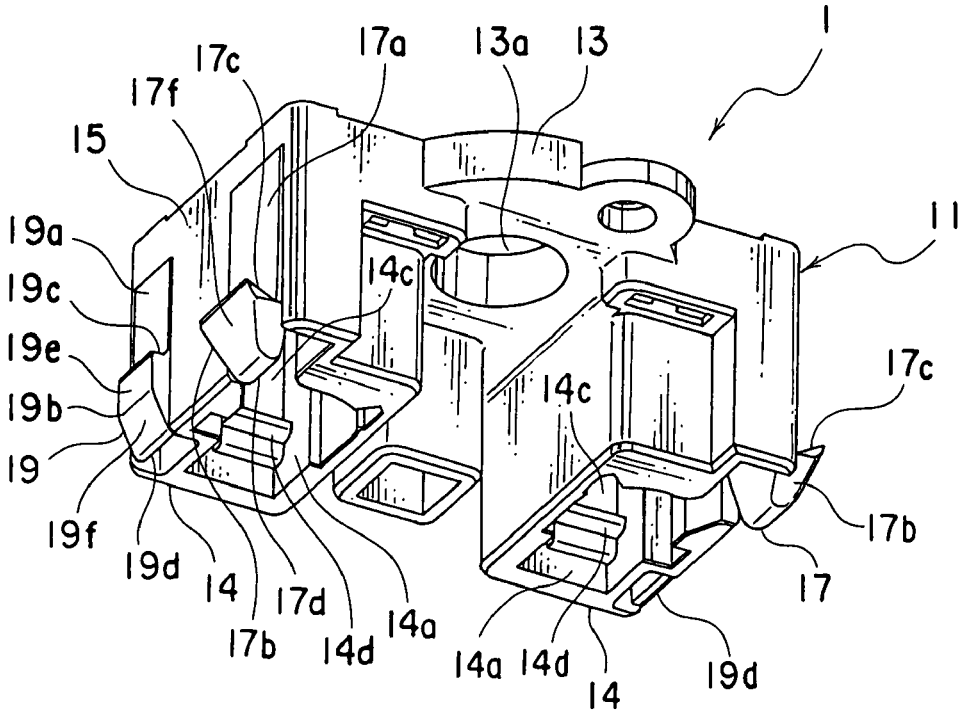
FIG. 1 is a perspective view showing a first connecting member of a connecting device having a locking mechanism according to a first embodiment of this invention.
Figure 2:
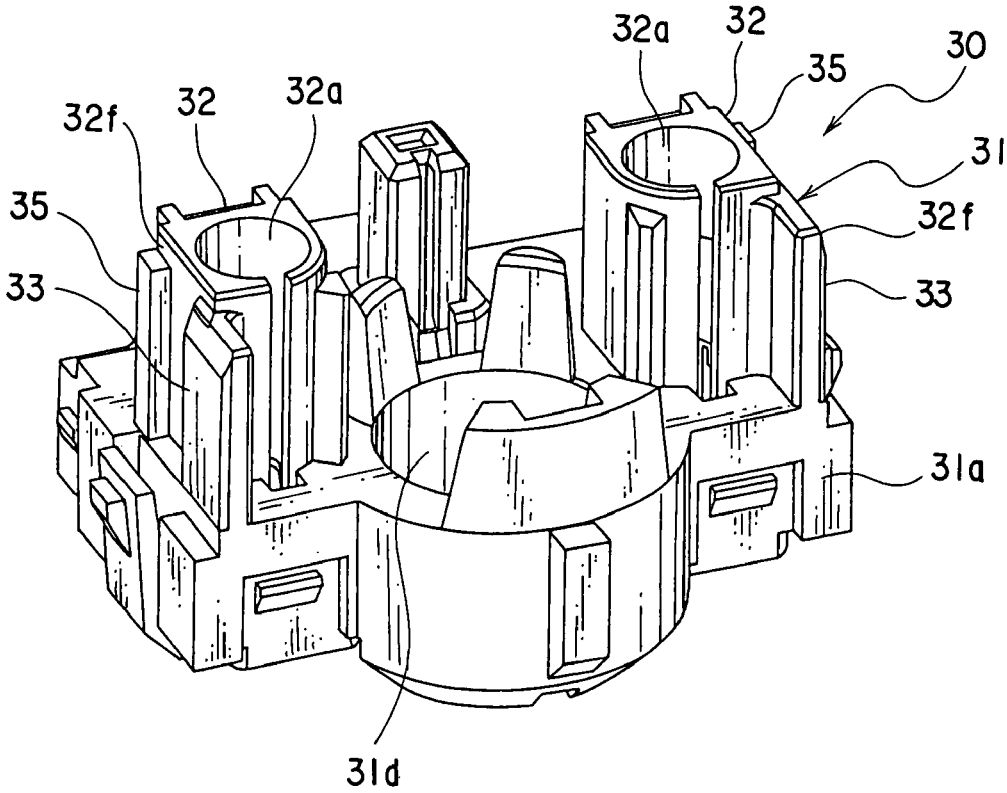
FIG. 2 is a perspective view showing a second connecting member for connection to the first connecting member shown in FIG. 1.
Figure 3:
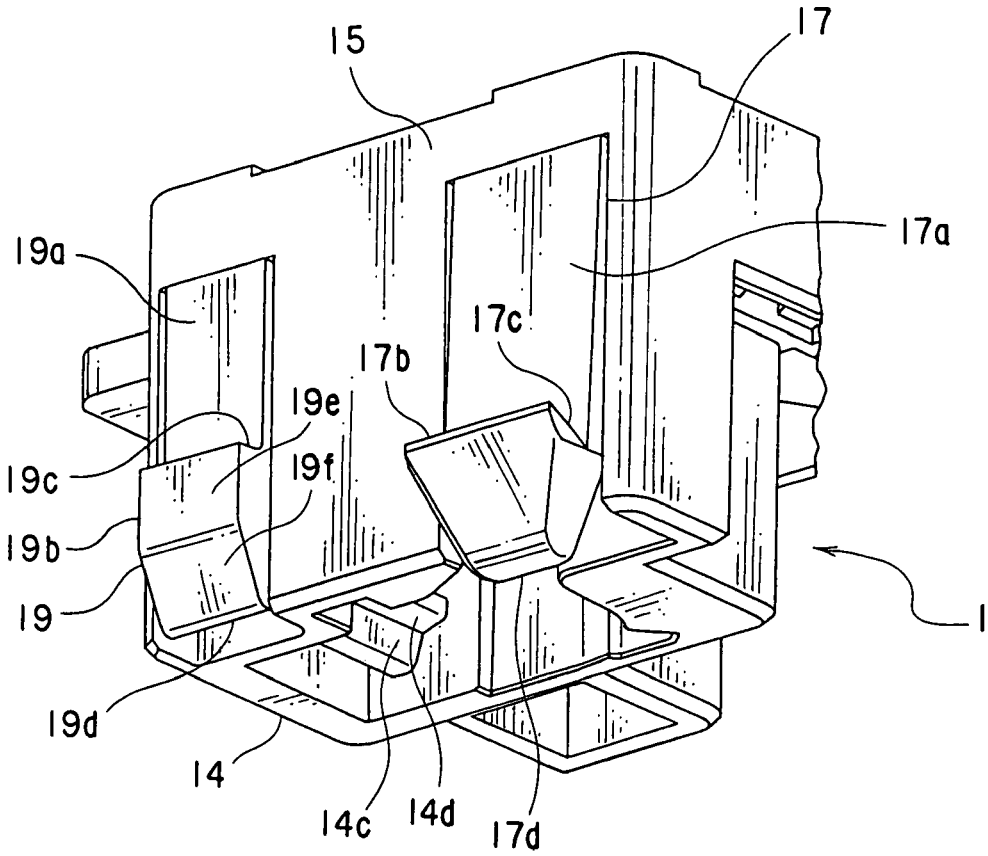
FIG. 3 is an enlarged perspective view enlargedly showing part of the first connecting member shown in FIG. 1.

FIG. 1 shows a first connecting member of a connecting device having a locking mechanism according to a first embodiment of this invention. FIG. 2 shows a second connecting member of the connecting device for connection to the first connecting member. FIG. 3 enlargedly shows part of the first connecting member.

The connecting device of the first embodiment is applied to an antenna device that is mounted to a roof panel of a vehicle serving as a mating side. A first connecting member 1 shown in FIG. 1 is attached to a non-illustrated mounting hole formed in the roof panel. A second connecting member 30 shown in FIG. 2 is connected to the first connecting member 1.

Referring to FIGS. 1 and 3, the first connecting member 1 has a first housing 11 of an insulating material. The first housing 11 has a plate-shaped first base portion 13, a pair of first block portions 14 respectively standing upright on the first base portion 13, and a locking mechanism formed at an outer surface of a sidewall portion 15 on one side of each of the first block portions 14.

The first block portions 14 are provided upright on the first base portion 13 on both left and right sides in FIG. 1, respectively.

At each of the first block portions 14, the locking mechanism comprises a first elastic body 17 connected to the sidewall portion 15 on the side of the first base portion 13 and a second elastic body 19 connected to the sidewall portion 15 on the side of the first base portion 13.

The locking mechanism serves to lock the first connecting member 1, being attached to the roof panel, so as to prevent it from coming off the roof panel.

The first elastic body 17 has an elongated plate-shaped first elastic plate portion 17*a*. One end of the first elastic plate portion 17*a* on the side of the first base portion 13 is connected to the corresponding one of the sidewall portions 15 opposed in parallel to each other. The first elastic body 17 has a free end portion formed with a first contact portion 17*b* projecting from the first elastic plate portion 17*a*.

The second elastic body 19 has an elongated plate-shaped second elastic plate portion 19*a*. One end of the second elastic plate portion 19*a* on the side of the first base portion 13 is connected to the corresponding one of the sidewall portions 15 opposed in parallel to each other. The second elastic body 19 has a free end portion formed with a second contact portion 19*b* projecting from the second elastic plate portion 19*a*.

When inserting the first connecting member 1 through the mounting hole of the roof panel, the first contact portions 17*b* are each pressed by contact with the inner edge of the mounting hole. When inserting the first connecting member 1 through the mounting hole of the roof panel, the second contact portions 19*b* are each pressed by contact with the inner edge of the mounting hole.

The first elastic bodies 17 serve to guide the first connecting member 1 when attaching the first connecting member 1 to the mounting hole. Further, after the first elastic bodies 17 are elastically deformed, the second contact portions 19*b* contact the inner edge of the mounting hole so that the second elastic bodies 19 are elastically displaced.

The first elastic bodies 17 absorb a clearance of the locking mechanism and accordingly serves as assist springs for controlling a posture of the first connecting member 1. The second elastic bodies 19 serve as a friction locking mechanism for locking engagement with the roof panel. Therefore, the locking mechanism allows insertion with a low insertion force and still exerts a high holding force.

The first contact portion 17*b* has a first locking portion 17*c* for holding the fitting to the roof panel in a locked state. The first locking portion 17*c* is a surface of a stepped portion projecting in a direction perpendicular to the surface of the first elastic plate portion 17*a*.

The second contact portion 19*b* has a second locking portion 19*c* for locking the fitting to the roof panel. The second locking portion 19*c* is a surface of a stepped portion projecting in a direction perpendicular to the surface of the second elastic plate portion 19*a*.

A tip 17*d* on the free end side of the first contact portion 17*b* of the first elastic body 17 extends more than a tip 19*d* on the free end side of the second contact portion 19*b* of the second elastic body 19.

Further, the first contact portion 17*b* has a first inclined surface 17*f* formed so as to be inclined from the side of the first locking portion 17*c* to the tip 17*d* on the free end side of the first contact portion 17*b*.

The second contact portion 19*b* has a flat surface 19*e* formed extending from the side of the second locking portion 19*c* so as to be parallel to the second elastic plate portion 19*a* and a second inclined surface 19*f* inclined from the flat surface 19*e* to the tip 19*d* on the free end side of the second contact portion 19*b*.

The first inclined surfaces 17*f* of the first contact portions 17*b* contact the inner edge of the mounting hole of the roof panel when attaching the first connecting member 1 to the roof panel. In this event, the first elastic bodies 17 are elastically deformed due to contact of the first contact portions 17*b* with the inner edge of the mounting hole. After the first elastic bodies 17 are elastically deformed, the second contact portions 19*b* contact the inner edge of the mounting hole of the roof panel. In this event, the second elastic bodies 19 are elastically deformed due to contact of the second inclined surfaces 19*f* of the second contact portions 19*b* with the inner edge of the mounting hole.

While the flat surfaces 19*e* of the second contact portions 19*b* are in contact with the inner edge of the mounting hole of the roof panel, the elastic deformation of the second elastic bodies 19 is in a saturated state. In this event, since the first inclined surfaces 17*f* of the first contact portions 17*b* are in contact with the inner edge of the mounting hole, the first elastic bodies 17 are in a state to be further elastically deformed.

The first block portions 14 are each formed with a first fitting hole 14*a* extending from the first base portion 13 through a tip surface of the first block portion 14. A first contact (not shown) is provided in the first fitting hole 14*a*. The first connecting member 1 provided with the first contacts serves as one of connectors.

The first connecting member 1 is connected to the second connecting member 30 shown in FIG. 2. The second connecting member 30 has a second housing 31 of an insulating material.

The second housing 31 has a second base portion 31*a* and a pair of second block portions 32 provided for fitting into the first fitting holes 14*a* of the first housing 11, respectively.

When the first connecting member 1 and the second connecting member 30 are fitted and connected together, the first block portions 14 and the second block portions 32 are fitted together. In this event, the second block portions 32 are fitted into the first fitting holes 14*a* of the first housing 11, respectively.

A rib-shaped first limiting portion 33 for limiting elastic deformation of the corresponding first elastic body 17 is formed on an outer surface of a sidewall portion 32*f* of each of the second block portions 32. Further, a plate-shaped second limiting portion 35 is formed on the outer surface of the sidewall portion 32*f* of each block portion 32. The second limiting portion 35 serves to limit elastic deformation of the corresponding second elastic body 19 when the first connecting member 1 and the second connecting member 30 are connected together.

The second block portions 32 are each formed with a second fitting hole 32*a*. A second contact (not shown) for connection to the first contact at the time of fitting is provided in each of the second fitting holes 32*a*. The second connecting member 30 provided with the second contacts serves as the other of the connectors.

A first through hole 13*a* (see FIG. 1) is formed at a substantially central portion of the first base portion 13 of the first connecting member 1. A second through hole 31*d* is formed at a substantially central portion of the second connecting member 30.

Figure 4:
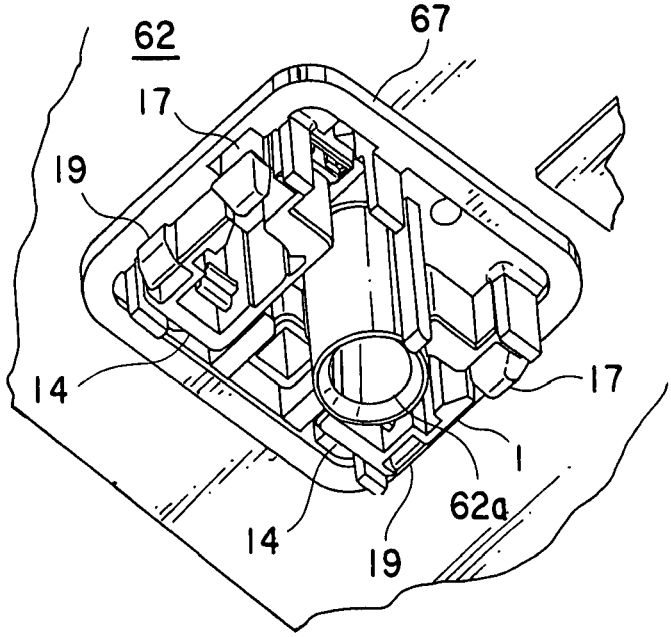
FIG. 4 is a perspective view showing a state where the first connecting member shown in FIG. 1 is applied to an antenna device and attached to a roof panel.

FIG. 4 shows a state where the first connecting member 1 is attached to a roof panel 51. As shown in FIG. 4, a tubular portion 62*a* standing upright on a base member 62 is inserted through the first through hole 13*a*. Further, when the first connecting member 1 and the second connecting member 30 are fitted together, the tubular portion 62*a* is inserted through the second through hole 31*d*.

As shown in FIGS. 4 to 8, an antenna device using the first connecting member 1 and the second connecting member 30 comprises an antenna body 61 disposed on one side of the roof panel 51 and a fixing device 63 (see FIG. 6) located on the other side of the roof panel 51. The fixing device 63 serves to completely fix the antenna body 61 to the roof panel 51.

The antenna body 61 comprises an antenna cover 65 and a pad 67 (see FIGS. 4 and 5) interposed between the antenna cover 65 and the roof panel 51. The antenna cover 65 is attached with an antenna element 69 for radio or television. The base member 62 is mounted in the antenna cover 65. A patch antenna (not shown), a board (not shown) provided with a circuit, and the first connecting member 1 are mounted on the base member 62.

The fixing device 63 comprises a bottomed cylindrical cover body 71 made of a conductive material such as, for example, stainless steel or nickel-plated iron, and a nut 72. The cover body 71 urges the first connecting member 1 upward. A coaxial cable 75 is connected to the second contacts provided in the second connecting member 30.

Assembly of the antenna device is roughly divided into three processes. That is, the first process is a process of temporarily attaching the first connecting member 1 and the antenna body 61 to the roof panel 51. The second process is a process of temporarily attaching the second connecting member 30 and the fixing device 63 to the first connecting member 1. The third process is a process of clamping/fixing the antenna body 61 to the roof panel 51.

In the first process, at first, the pad 67 is positioned around a mounting hole 51*a* (see FIG. 8) on the roof panel 51 and the first connecting member 1 is inserted into the mounting hole 51*a*. In this event, the first and second contact portions 17*b* and 19*b* of the first and second elastic bodies 17 and 19 are pressed against the inner edge of the mounting hole 51*a*.

Therefore, the first and second elastic plate portions 17*a* and 19*a* of the first and second elastic bodies 17 and 19 pass through the mounting hole 51*a* while bending. Then, after the first contact portions 17*b* have passed through the mounting hole 51*a*, they return to the original shape and project from the mounting hole 51*a*.

In the first process, the first connecting member 1 is temporarily attached to the roof panel 51 by engagement of the first locking portions 17*c* of the first housing 11 with the back side of the roof panel 51. In the second process, the second connecting member 30 and the fixing device 63 are temporarily attached to the first connecting member 1 by insertion into the first connecting member 1.

Further, in the third process, the antenna device is assembled and fixed to the roof panel 51 by tightening the nut 72 of the fixing device 63. In this event, the first contacts and the second contacts are electrically connected together.

In each of the first fitting holes 14*a* of the first connecting member 1, there is formed an additional elastic body 14*c* (see FIGS. 1 and 3) extending parallel to the axial direction of the first fitting hole 14*a* from the first base portion 13. A stripe-shaped first additional locking portion 14*d* is formed at a free end portion of the additional elastic body 14*c*. When the second connecting member 30 shown in FIG. 2 is inserted and connected to the first connecting member 1, the additional elastic bodies 14*c* are elastically deformed.

Figure 9:
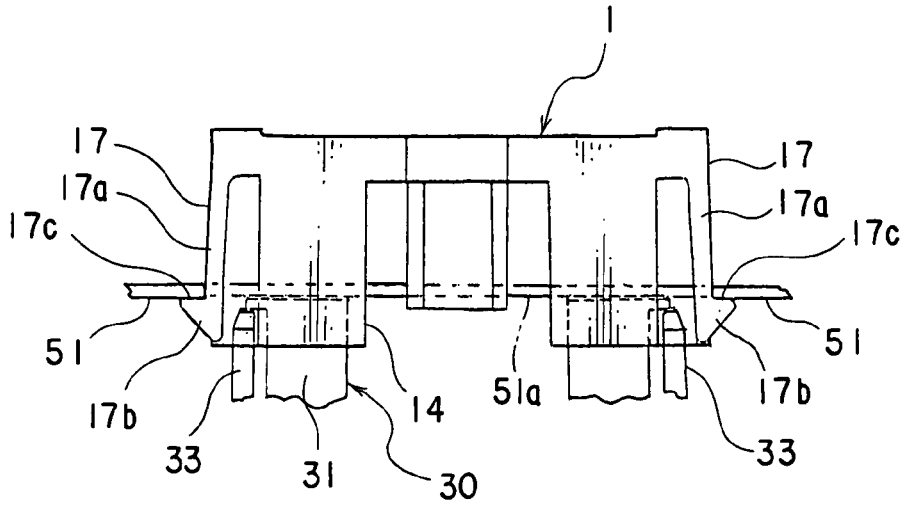
FIG. 9 is an explanatory diagram showing a state before the first connecting member and the second connecting member shown in FIGS. 1 and 2 are fitted together.
Figure 10:
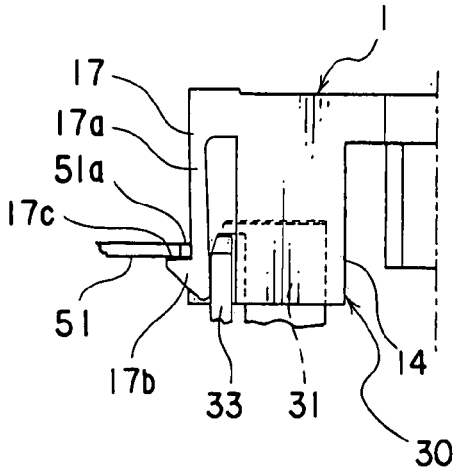
FIG. 10 is an explanatory diagram showing a temporary assembly state of the first connecting member and the second connecting member shown in FIG. 9.
Figure 11:
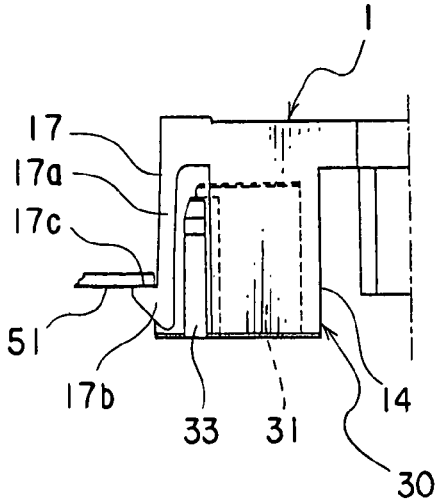
FIG. 11 is an explanatory diagram showing a state where the first connecting member and the second connecting member shown in FIG. 10 are fitted together.

FIGS. 9 to 11 show the positional relationship between the first and second elastic bodies 17 and 19 and the first and second limiting portions 33 and 35 in the process of fitting the second connecting member 30 into the first connecting member 1.

FIG. 9 shows a state before the second connecting member 30 is temporarily attached to the first connecting member 1. In a temporary fitting state, as shown in FIG. 10, the additional elastic body 14*c* returns to a state before the temporary attachment. This is because the second connecting member 30 is locked by the first additional locking portion 14*d* after the additional elastic body 14*c* is deformed by the second block portion 32. In this event, the second connecting member 30 is locked to the first connecting member 1 in the temporary fitting state. In a complete fitting state, as shown in FIG. 11, elastic deformation of the first and second elastic bodies 17 and 19 is limited by the first and second limiting portions 33 and 35.

Incidentally, only the limiting portions 33 or 35 may be provided to limit the deformation of the corresponding first or second elastic bodies 17 or 19.

Figure 12:
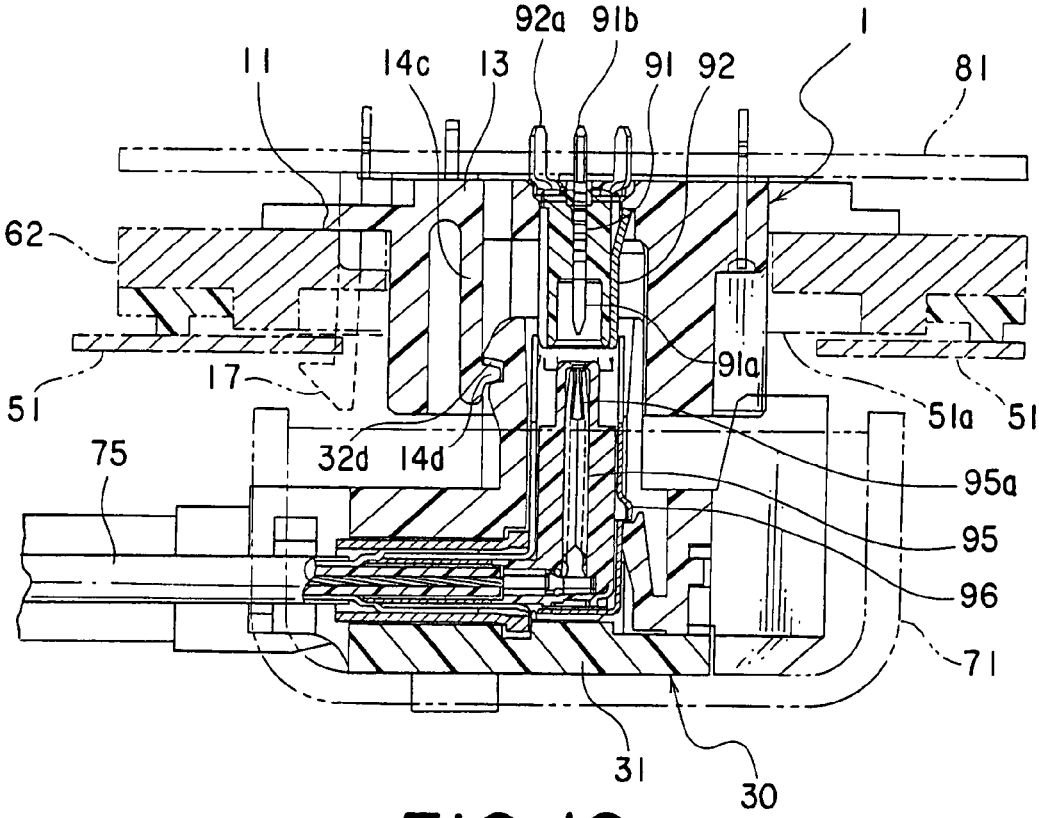
FIG. 12 is a sectional view showing a connecting device having a locking mechanism, in a state before fitting, according to a second embodiment of this invention.
Figure 13:
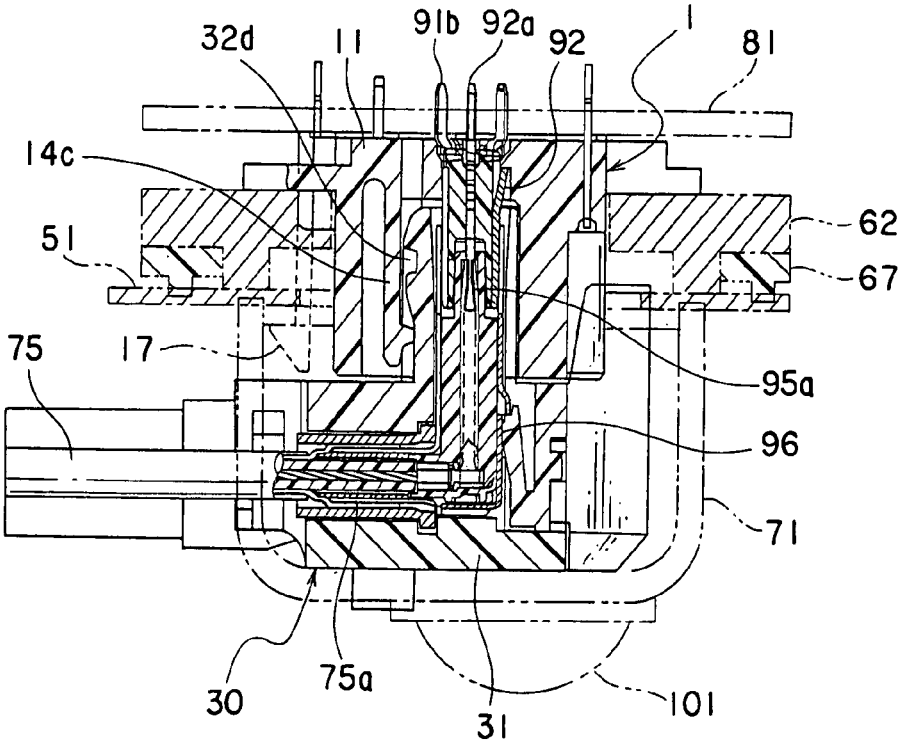
FIG. 13 is a sectional view showing a fitting state of the connecting device having the locking mechanism shown in FIG. 12.

FIGS. 12 and 13 show, as a second embodiment of this invention, a configuration where a first connecting member 1 and a second connecting member 30 are applied to form an antenna device. The same components as those in the first embodiment are assigned the same reference symbols.

Figure 5:
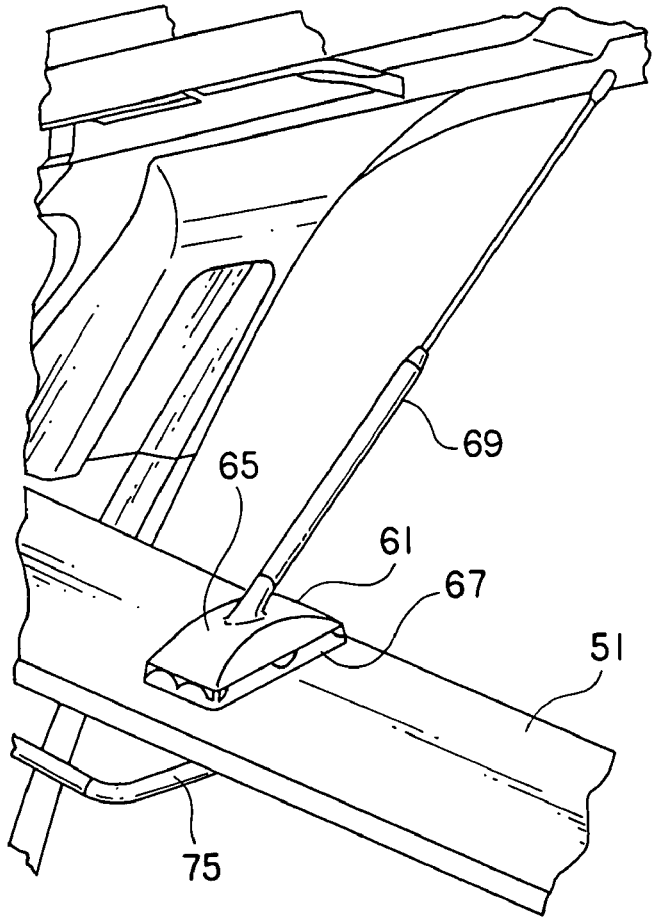
FIG. 5 is a perspective view for explaining a mounting state of the antenna device shown in FIG. 4.

The antenna device is mounted to a roof panel 51. An antenna body 61 shown in FIG. 5 is disposed on one side of the roof panel 51. On the other side of the roof panel 51, there is disposed a fixing device 63 that serves to fix the antenna body 61 to the roof panel 51.

Figure 6:
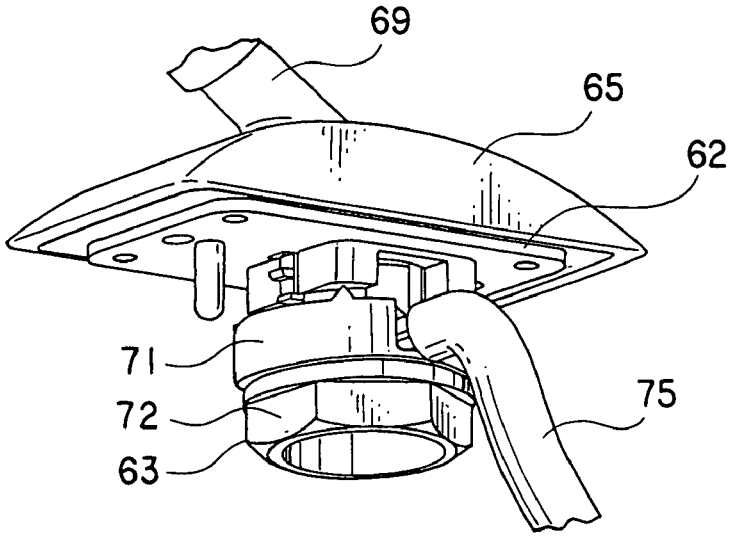
FIG. 6 is a perspective view showing a state where the antenna device shown in FIG. 5 is detached from the roof panel and a pad is removed.
Figure 7:
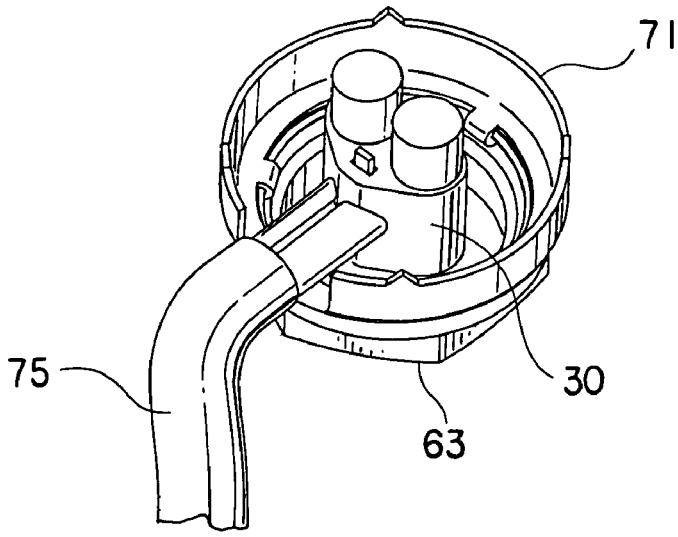
FIG. 7 is a perspective view showing a fixing device, the second connecting member, and a cover body shown in FIG. 6.
Figure 8:
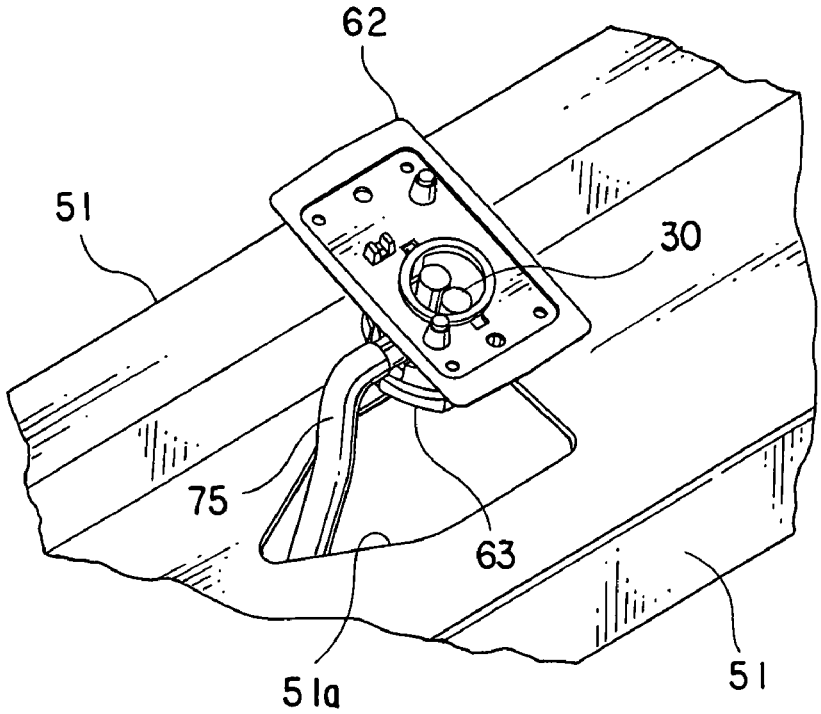
FIG. 8 is a perspective view showing the fixing device and a base member shown in FIG. 6.

As shown in FIGS. 5 and 6, a base member 62 is mounted in an antenna cover 65. A patch antenna (not shown), a board 81 shown in FIG. 12, and the first connecting member 1 are mounted on the base member 62.

An additional elastic body 14*c* is formed in a first fitting hole 14*a* of the first connecting member 1. In the first fitting hole 14*a*, the additional elastic body 14*c* extends parallel to the axial direction of the first fitting hole 14*a* from a first base portion 13. A stripe-shaped first additional locking portion 14*d* is formed at a free end portion of the additional elastic body 14*c*.

In the first fitting hole 14*a*, a first contact 91 is provided parallel to the axial direction of the first fitting hole 14*a*. The first contact 91 comprises a first contact portion 91*a* extending toward one side from its holding portion held by the first base portion 13 of the first connecting member 1 and a first terminal portion 91 b extending from the other side of the holding portion so as to be connected to a circuit formed in the board 81.

The first contact 91 is held by a portion of the first connecting member 1. A first external conductor 92 is provided on a portion of an outer surface of the first contact 91. A first conductor terminal 92*a* of the first external conductor 92 is connected to a ground circuit of the board 81.

A groove-shaped second additional locking portion 32*d* is formed in a second fitting hole 32*a* of the second connecting member 30. The second additional locking portion 32*d* is located at an inner wall surface arranged parallel to the axial direction of the second fitting hole 32*a*.

In the second fitting hole 32*a*, a second contact 95 is provided parallel to the axial direction of the second fitting hole 32*a*. The second contact 95 has a second contact portion 95*a* extending to one end from its holding portion held by the second connecting member 30.

The other end of the second contact 95 is connected to a center conductor 75*a* of a cable 75. The second contact 95 is held by a portion of the second connecting member 30. A second external conductor 96 is provided on a portion of an outer surface of the second contact 95. The second external conductor 96 is connected to an external conductor of the cable 75.

In the middle of inserting and fitting the second connecting member 30 into the first connecting member 1, the second connecting member 30 is temporarily attached to the first connecting member 1. At the time of fitting after releasing the temporary attachment, the first and second contacts 91 and 95 are connected together. When the first connecting member 1 and the second connecting member 30 have been fitted together, a two-stage friction locking mechanism is provided by the first and second additional locking portions 14*d* and 32*d*.

The first connecting member 1, the patch antenna (not shown), for example, for a high frequency range, and the board 81 are attached to the antenna body 61. A terminal of the board 81 is connected to an antenna element 69 through a lead line. Thereafter, the antenna cover 65 is attached to the antenna body 61. In this event, in the fixing device 63 shown in FIG. 6, a bolt 101 is inserted into a through hole (not shown) formed in a cover body 71.

In a first process of temporarily attaching the first connecting member 1 to the roof panel 51, the second connecting member 30 is inserted into the first connecting member 1. In the first process, first and second locking portions 17*c* and 19*c* of first and second elastic bodies 17 and 19 engage with the back side of the roof panel 51. In this event, the first connecting member 1 is temporarily attached to the roof panel 51. Further, as shown in FIG. 12, the first additional locking portion 14*d* of the additional elastic body 14*c* enters the second additional locking portion 32*d*, thereby carrying out locking (temporary attachment) of a second process. In the temporary attaching state in the second process, the first contact portion 91*a* and the second contact portion 95*a* are not in contact with each other.

In a third process, as shown in FIG. 13, the second connecting member 30 is further inserted into the first connecting member 1, so that the first contact portion 91*a* and the second contact portion 95*a* are brought into contact with each other. In this event, the second external conductor 96 is brought into contact with the first external conductor 92 so as to be grounded. Further, the first additional locking portion 14*d* of the additional elastic body 14*c* and the second additional locking portion 32*d* are disengaged from each other, so that the additional elastic body 14*c* returns to the original shape.

Further, in the third process, after the first connecting member 1 and the second connecting member 30 have been fitted together, the cover body 71 is firmly fixed by screwing the bolt 101 into a threaded portion (not shown) formed in a tubular portion 62*a*.

At the time of the temporary attachment described in FIG. 12, the first and second contacts 91 and 95 are not in contact with each other. At the time of the complete fitting shown in FIG. 13, the first and second contacts 91 and 95 are brought into contact with each other.

Therefore, by checking electrical continuity, the complete fitting between the first connecting member 1 and the second connecting member 30 can be easily judged based on the presence or absence of electrical connection.

In the connecting device having the locking mechanism, the first elastic body 17 serves as a guide when temporarily attaching the first connecting member 1 to the roof panel 51.

Therefore, when attaching the first connecting member 1 to the roof panel 51, it is possible to reduce an insertion force. Further, when attaching the first and second connecting members 1 and 30 to the roof panel 51, it is possible to simplify the mounting operation and thus to reduce a load of a mounting dealer.

Further, it is possible to ensure a mounting strength of the first connecting member 1 to the roof panel 51 so as to bear a load applied when the second connecting member 30 is fitted thereto.

Further, it is possible to temporarily attach the second connecting member 30 to the first connecting member 1 by one-touch operation with one hand.

Therefore, in the process subsequent to the temporary attachment in the mounting operation, it is possible to smoothly shift to the screwing operation using a tool for fixing the second connecting member 30.

A connecting device having a locking mechanism of this invention is also applicable to a use such as a switch connector or a vehicle body connector. The switch connector is adapted to connect and disconnect a circuit by insertion and removal operations thereof. The body connector is fixed to a vehicle body on the door side or the body side at a portion where a door portion and a body portion are separated from each other, wherein another connector is connected thereto after the fixation.

What is claimed is:

1. A connecting device including a locking mechanism for locking fitting between a first connecting member and a panel, wherein said locking mechanism comprises:

a pair of first elastic bodies being arranged opposite to each other; and a pair of second elastic bodies being arranged opposite to each other;

wherein each of said first elastic bodies includes a first contact portion adapted to contact said panel;

wherein each of said second elastic bodies includes a second contact portion adapted to contact said panel;

wherein said first contact portion comprises:

a first inclined surface coming in contact with said panel to elastically deform said first elastic body; and a locking portion engaging with said panel and being fitted to said panel after elastically deforming said first elastic body;

wherein said second contact portion comprises:

a second inclined surface coming in contact with said panel to elastically deform said second elastic body; and a flat surface coming in contact with said panel to elastically deform said second elastic body, thereby pressing said panel; and wherein said second elastic body is deformed by said second inclined surface after said first elastic body is deformed by said first inclined surface.

2. The connecting device according to claim 1, wherein said first contact portion contacts with said panel to elastically deform said first elastic body when said first connecting member fits to said panel, and then, said second contact portion contacts with said panel to elastically deform said second elastic body.

3. The connecting device according to claim 1, further comprising a second connecting member for connection to said first connecting member, wherein said second connecting member comprises a second housing, and said second housing has a limiting portion adapted to limit deformation of at least one of said first elastic body and said second elastic body when said second connecting member is connected to said first connecting member.

4. The connecting device according to claim 3, wherein said first connecting member has a first housing, said first housing is provided with a first contact and said second housing is provided with a second contact adapted to be connected to said first contact when said second connecting member is fitted to said first connecting member.

5. The connecting device according to claim 4, wherein said first contact and said second contact are connected together after said first connecting member and said second connecting member are fitted together.

6. The connecting device according to claim 5, wherein said first housing has an additional elastic body, said additional elastic body has a first additional locking portion, and said second housing has a second additional locking portion adapted to engage with said first additional locking portion so as to temporarily attach said second connecting member to said first connecting member in the middle of inserting and fitting said second connecting member into said first connecting member.

* * * * *